United States Patent [19]

Horiye et al.

[11] Patent Number: 5,072,627

[45] Date of Patent: Dec. 17, 1991

[54] STARTING APPARATUS FOR AN ENGINE

[75] Inventors: Fusamaro Horiye; Hitoshi Ishii, both of Osaka, Japan

[73] Assignee: Yanmar Diesel Engine Co., Ltd., Osaka, Japan

[21] Appl. No.: 681,661

[22] Filed: Apr. 8, 1991

Related U.S. Application Data

[63] Continuation of Ser. No. 396,269, Aug. 21, 1989, abandoned.

[30] Foreign Application Priority Data

Oct. 14, 1988 [JP] Japan ..... 63-260202

[51] Int. Cl.[5] ..... F02N 3/02; F02N 11/00

[52] U.S. Cl. ..... 74/6; 74/625

[58] Field of Search ..... 74/6, 625; 123/179 P, 123/179 SE, 182; 320/2; 310/47

[56] References Cited

U.S. PATENT DOCUMENTS

| | | | |
|---|---|---|---|
| 2,939,448 | 6/1960 | Hansen | 123/179 P |
| 3,219,021 | 11/1965 | Mercer et al. | 123/179 P |
| 3,536,051 | 10/1970 | Hamman | 123/179 SE |
| 3,696,593 | 10/1972 | Thorud et al. | 123/179 SE |
| 3,999,110 | 12/1976 | Ramstrom et al. | 320/2 |
| 4,274,292 | 6/1981 | Arnett, Jr. | 74/7 E X |
| 4,447,749 | 5/1984 | Reeb, Jr. et al. | 320/2 X |
| 4,555,849 | 12/1985 | Ando et al. | 320/2 |
| 4,578,628 | 3/1986 | Siwiak | 320/2 |
| 4,848,288 | 7/1989 | Murase et al. | 123/179 P |

FOREIGN PATENT DOCUMENTS 60-156976 8/1985 Japan .

*Primary Examiner*—Allan D. Herrmann

*Attorney, Agent, or Firm*—Armstrong, Nikaido, Marmelstein, Kubovcik & Murray

[57] ABSTRACT

A starting apparatus for a 4-cycle gasoline engine in which a necessary capacity of a starter motor is reduced by arranging that the engine can be started in a low revolution region of less than 350 rpm, and in which the starter motor is mounted around a starting clutch mechanism connected to a crankshaft. The starter motor is mounted to a recoil starter and connected to a rotary portion of the recoil starter in interlocking relation.

6 Claims, 9 Drawing Sheets

STARTING APPARATUS FOR AN ENGINE

This application is a continuation of application Ser. No. 396,269 filed Aug. 21, 1989, now abandoned.

BACKGROUND OF THE INVENTION

1. Field of the Invention

The present invention relates to a starting apparatus for engines and, more particularly, to a starting apparatus for use in a 4-cycle gasoline engine of the type which is to be started by a starter motor.

2. Description of the Prior Art

A conventional starting apparatus for a 4-cycle gasoline engine of this type is schematically shown in FIG. 19. A flywheel 4 having a cooling fan 3 formed integrally therewith is mounted to a crankshaft 2 projecting from an engine body 1. A ring gear 5 is mounted on the outer periphery of flywheel 4. Mounted to one side of the engine body 1 is a starter motor 6 having a length substantially equal to the width of the engine body 1 and from which extends a driving shaft 7 to which a driving gear 8 is axially movably fixed. As the starter motor 6 is driven, the driving gear 8 projects forward to bring the driving gear 8 into engagement with the ring gear 5 so that the crankshaft 2 is driven to rotate through the flywheel 4. When the engine is started, the driving gear 8 retracts to its original position to disengage the driving gear 8 from the ring gear 5. A power source for driving the starter motor 6 is separately provided in the form of a battery of about one half the size of the engine body 1, which is connected to the starter motor 6.

As above noted, the conventional 4-cycle gasoline engine requires a starter motor 6 having a body portion of a length substantially equal to the width of the engine body 1. Therefore, such engine has a disadvantage in that if the starter motor 6 is mounted to the engine body 1, the external size of the engine as a whole is exceptionally large. Another disadvantage is that driving such a large-size starter motor 6 requires a large-size battery as a power source which, as above noted, must be mounted in position separately from the engine body 1 since it is impractical to mount the battery to the engine body 1. Further, with conventional engines of the type designed to be mounted to a field work machine, including engines of recoil starter specification and those of starter motor specification, one disadvantage is that, if the engine is of the starter motor specification, an extra space is required for mounting the battery, which permits no easy mounting of the engine on the field work machine, if the machine is of the recoil starter specification; and in such case, it is further required that wiring arrangement be made between the battery and the starter motor. A further disadvantage is that if an engine of starter motor specification is to be mounted in addition to an engine of recoil starter specification which is provided with no ring gear 5, the flywheel 4 portion of the latter engine must be totally replaced.

It is noted that 2-cycle engines of a very small capacity of less than 50 cc have been known which are equipped with a starter motor and a battery, both of small size. However, no engine of such arrangement has been known as far as 4-cycle engines of small capacities ranging from about 50 cc to about 250 cc are concerned, and it has been considered to be impractical to obtain an engine of such arrangement.

The present invention is directed to eliminating the above noted disadvantages with the prior art 4-cycle gasoline engines and accordingly it is a primary object of the invention to provide a starting apparatus which is compact in construction and permits a starter motor and a battery together to be integrally incorporated into an engine body.

SUMMARY OF THE INVENTION

In order to accomplish aforesaid object, in accordance with the present invention, a starting apparatus for a 4-cycle gasoline engine is provided which comprises a starter motor having a reduced capacity and adapted to be able to start the engine by arranging that the engine can be started in a low revolution region of less than 350 rpm, said starter motor being mounted about a starting clutch mechanism connected to a crankshaft.

According to another aspect of the invention, a starting apparatus for a 4-cycle gasoline engine is provided which comprises a starter motor having a reduced capacity and adapted to be able to start the engine by arranging that the engine can be started in a low revolution region of less than 350 rpm, said starter motor being mounted to a recoil starter and interlocked with a rotary portion of the recoil starter.

For arranging that the engine can be started in a low revolution region of less than 350 rpm, the following means may be used either in part or in combination:

automatic reduction of the pressure in the cylinder at the stage of low rate revolutions;

adapting the carburetor to provide adequate air fuel ratio at the low revolution region;

adapting the carburetor to provide air fuel ratio suitable for ignition without choking control;

lowering the spark rotation speed of the ignition device;

delaying spark to a point of time at which reversing of ignition timing can be avoided (e.g., a point near top dead point); and increasing the secondary side voltage of the ignition coil.

According to the arrangement of the present invention, the engine can be started in a low speed region of less than 350 rpm and, therefore, the torque required for starting is small and the size of the starter motor may be of about same order as the width of the recoil starter. Therefore, a battery comprising 10 cells of about 1.2V each is just sufficient for use with the starter motor to start the engine. The battery can also be mounted to the engine body. Thus, a starting apparatus of very compact construction can be obtained.

DESCRIPTION OF THE PREFERRED EMBODIMENTS

Figure 1:
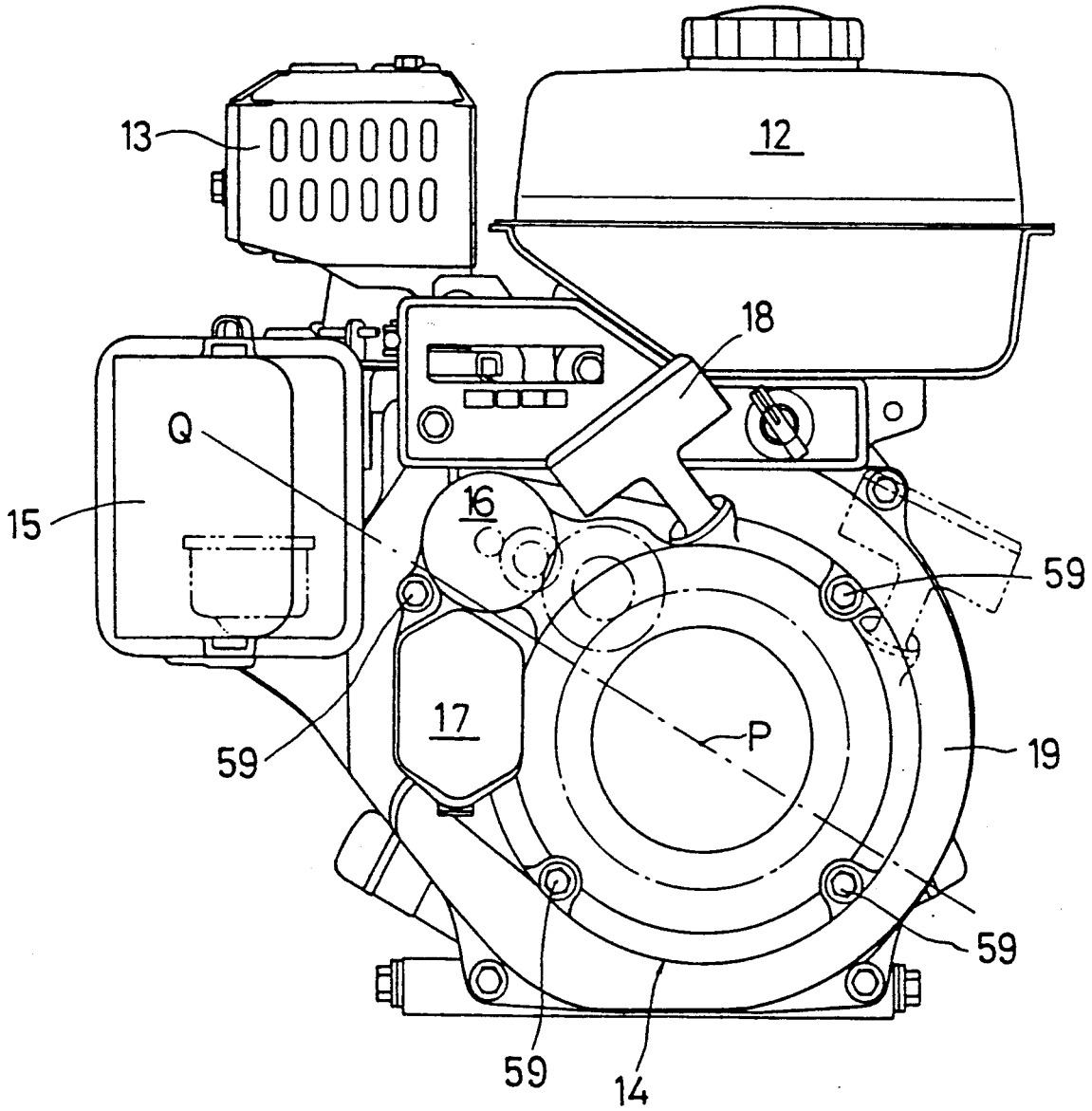
FIG. 1 is a general view in front elevation showing an engine representing one embodiment of the present invention.
Figure 2:
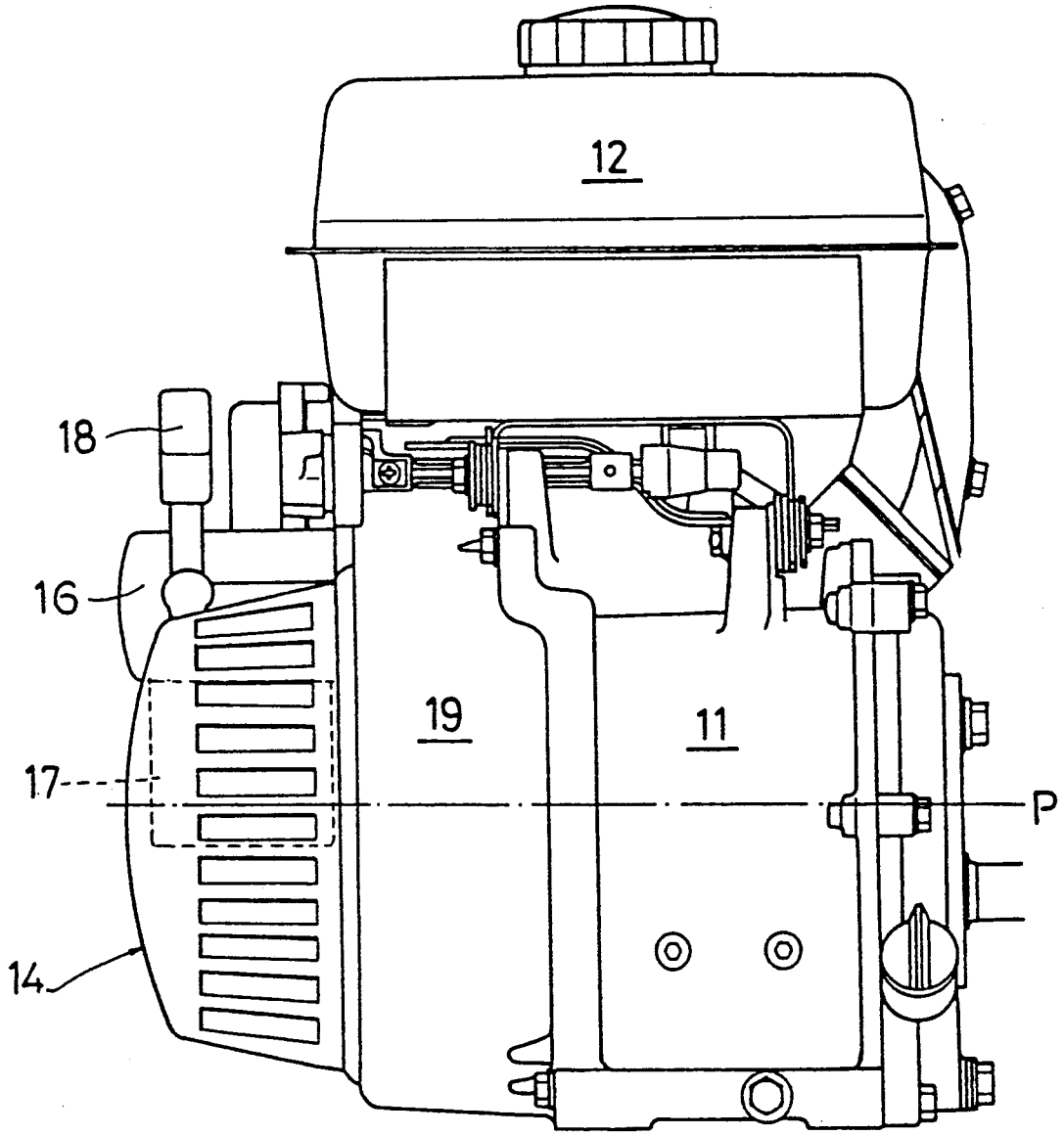
FIG. 2 is a side view of the engine as seen from the righthand side in FIG. 1.

FIGS. 1 and 2 are general views in elevation showing an inclined 4-cycle gasoline engine representing one embodiment of the invention in which a center line Q of a cylinder is obliquely inclined relative to axis P of a crankshaft. A fuel tank 12 is mounted above an engine body 11 positioned right above the crankshaft axis P, and an exhaust muffler 13 is mounted on an upper portion of a cylinder head positioned adjacent one side of the fuel tank 12. A fan case 19 is mounted to one side of the engine body 11 as viewed in the direction of the crankshaft axis P, and a recoil starter 14 is mounted to one side of the fan case 19. An air cleaner 15 is disposed at a level above the crankshaft axis P and adjacent one side of the cylinder head at same side as the recoil starter 14 is mounted. Mounted between this air cleaner 15 and the recoil starter is a starter 14 motor 16 under which a battery 17 is mounted. A puller 18 for pulling a starting rope projects upwardly from a top portion of the coil starter 14.

Figure 3:
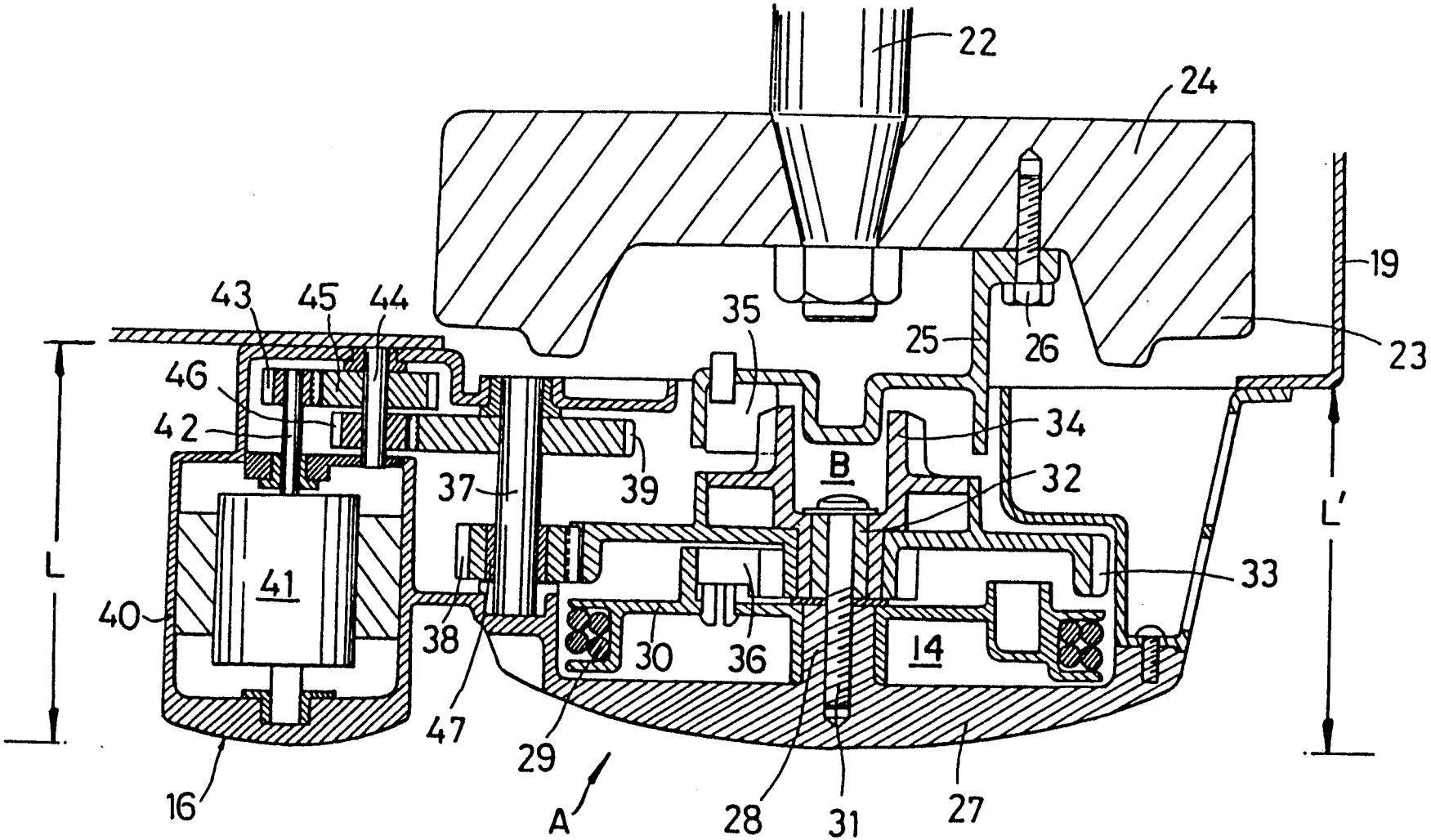
FIG. 3 is a transverse sectional plan view showing recoil starter and fan case portions.

FIG. 3 shows an internal arrangement of both the coil starter 14 and the fan case 19. A flywheel 24 equipped with a cooling fan 23 is mounted to an end of a crankshaft 22 projecting from the engine body 11. Fixed by a bolt 26 to one side of the flywheel 24 is a driven member 25 which projects into a saucer-shaped recoil starter case 27. A starter wheel 30 around which a rope 29 is wound is rotatably fitted on a shaft portion 28 extending centrally from a ceiling portion of the recoil starter case 27. A large reduction gear 33 and a drive member 34 are integrally rotatably fitted together on a shaft 32 fixed to an end of the shaft portion 28 through a machine screw 31. The drive member 34 and the driven member 25 are co-movably interconnected through a first clutch 35. The large reduction gear 33 and the starter wheel 30 are co-movably interconnected through a second clutch 36. At a location adjacent one side of the first and second clutches or, more specifically, obliquely above the crankshaft axis P, is rotatably supported an intermediate shaft 37 to which are integrally rotatably mounted a small-diameter intermediate pinion 38 engageable constantly with the large reduction gear 33 and another driven intermediate gear 39. A third clutch 47 is provided between the intermediate pinion 38 and the intermediate shaft 37. The starter motor 16 comprises a motor case 40 formed integrally with the recoil starter case 27 forming an integral case, generally designated A, FIG. 3, and a motor body 41 disposed therein, and further comprises a drive pinion 43 mounted to front end of a motor shaft 42 projecting from the motor body 41, the drive pinion 43 being in engagement with a gear 45 on a driven shaft 44 rotatably supported between the motor case 40 and an extension of the recoil starter case 27, and a pinion 46 mounted on the driven shaft 44, the pinion 46 being in engagement with the driven gear 39 on the intermediate shaft 37. Gear 38 on intermediate shaft 39 is in engagement with larger gear 33 of recoil starter 14 which, with clutch 35 and driven gear 25 on flywheel 24, forms a rotary portion, generally designated B, FIG. 3, of the recoil starter 14.

The arrangement shown in FIG. 3 is such that as the starter motor 16 is driven, rotational force from the pinion 43 on the driving shaft 42 is sequentially transmitted while being reduced to the gears 45, 46, and the driven gear 39 and pinion 38 on the intermediate shaft 37 in the order of mention, and is then transmitted from the pinion 38 on the intermediate shaft 37 to the large reduction gear 33 in the form of a largely reduced torque until rotation is transmitted to the crankshaft 22 through the first clutch 35 between the driving member 34 and the driven member 25 to start the engine. When the engine starts, the first clutch 35 is automatically disconnected; therefore, the driving member 34 will not be rotated from the crankshaft 22 side. As the engine is started by the starter motor 16, the third clutch 47 is connected, but the starter wheel 30 does not rotate because the second clutch 36 does not transmit power from the large gear 33 to the starter wheel 30. When the puller 18 is pulled to draw the rope 29, the starter wheel 30 is rotated and this rotation is transmitted through the second clutch 36 to the large reduction gear 30, and in turn the crankshaft 22 is rotated via the first clutch 35 for starting. Thereupon, rotation is transmitted from the large gear 33 to the pinion 38 held in engagement therewith, but the third clutch 47 between the pinion 38 and the intermediate shaft 37 is of one-way clutch construction such that no rotation is transmitted through it to the intermediate shaft 37; therefore, the starter motor 16 side members are not rotated in the course of starting by the recoil starter 14.

Figure 5:
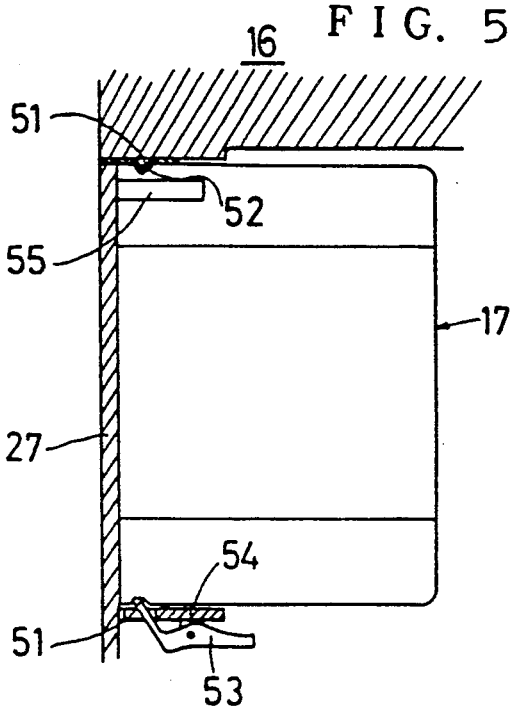
FIG. 5 is a fragmentary view in longitudinal section showing the battery mounted in position.
Figure 4:
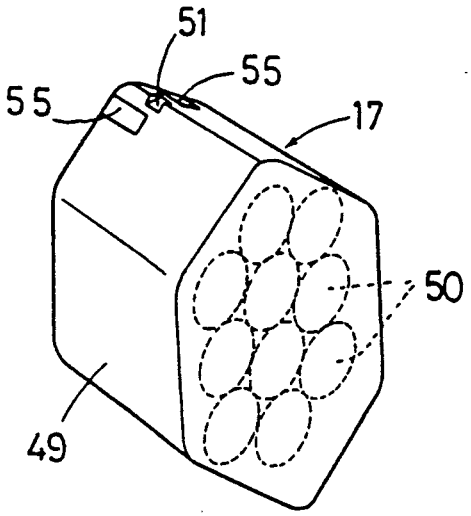
FIG. 4 is a perspective view of a battery.
Figure 6:
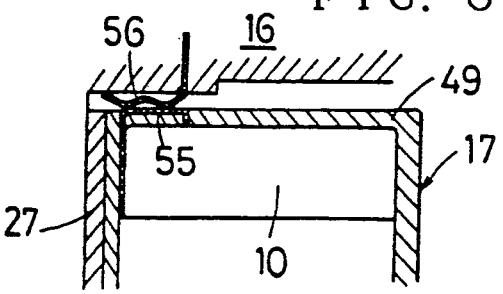
FIG. 6 is a fragmentary view in longitudinal section showing terminal connections between the battery and a starter motor.

The battery 17 for driving the starter motor 16, as FIG. 4 shows, comprises 10 dry cells 50, 50 . . . of the charging type, each of about 1.2V, fitted in a cylindrical case 49 of a generally hexagonal shape, and as FIG. 5 shows, it has engagement grooves 51, 51 formed at upper and lower sides thereof. A plate spring-made engaging projection 52 engageable with one of the grooves 51 is fixed to one side of the motor case 40, and a lever 53 is fixed to an opposite side of the coil starter case 27, opposite to the motor case 40 side. This lever 53 is urged by a spring, not shown, so that its front end constantly projects inwardly of a mounting member 54 for the lever 53. Therefore, as the battery case 49 is inserted between the projection 52 and the lever 53, projection 52 and lever 53 go into engagement with the grooves 51, 51 under the action of the springs, thereby holding the case 49 in position. It is noted, in this connection that on the battery case 49 at opposite sides of the upper groove 51, plus and minus terminals 55, 55 are disposed open, while on the motor case 40 side, corresponding plus and minus terminals 56, 56 are disposed open, so that when the battery case 49 is fitted in position as above noted, such terminals go into contact interconnecting the battery 17 and the motor 16. The dry cells 50, 50 . . . are of the rechargable type, as already mentioned and can be readily recharged utilizing a commercial power supply. The battery case 49 can easily be removed by manipulating the lever 53.

As FIGS. 2 and 3 show, the starter motor 16 is so disposed alongside the recoil starter case 27 that its driving shaft 42 is oriented codirectionally with the crankshaft 22, and its length L in the axial direction of the crankshaft 22 is substantially the same as the length L' of the recoil starter case 27. In addition, the transverse dimentional size of the starter motor 16 is such that the motor 16 is conveniently housed in the dead space between the air cleaner 15 and the recoil starter 14. Accordingly, the battery 17 is likewise of such size that it is housed within a space corresponding to the width of the recoil starter case 14. Because the starter motor 16 and battery 17 are in this way compacted, they can be readily housed in place when they are mounted on an engine.

Figure 7:
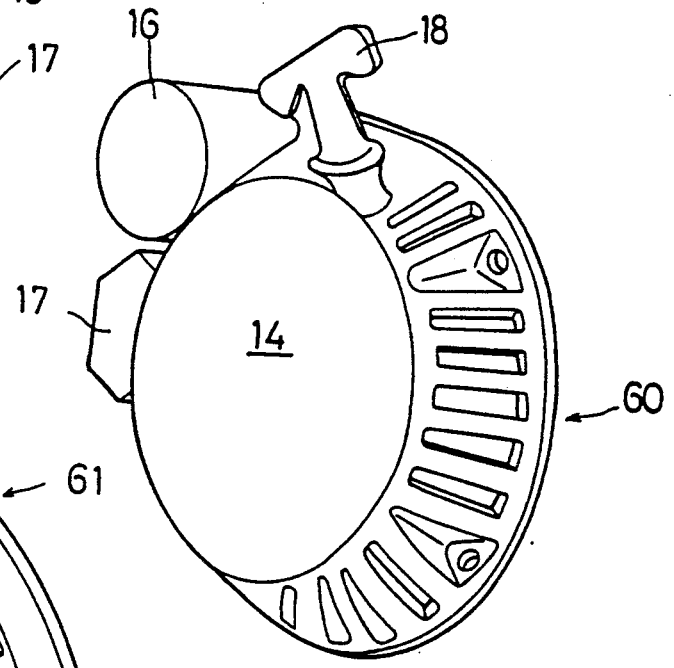
FIG. 7 is a perspective view showing a recoil starter equipped with a starter motor and a battery.
Figure 8:
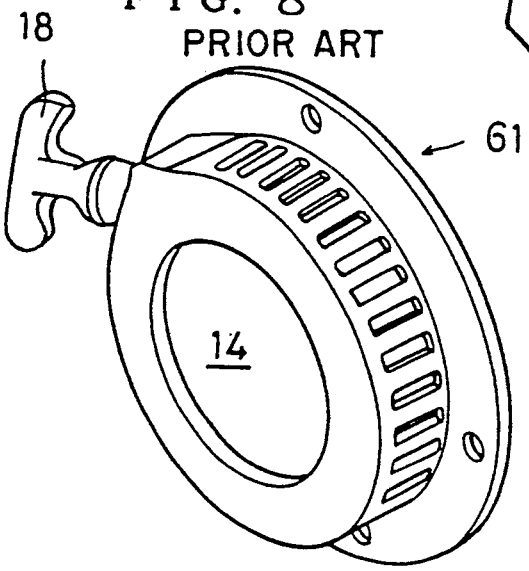
FIG. 8 PRIOR ART
FIG. 8 is a perspective view showing a conventional recoil starter.

As FIG. 7 shows, the starter motor 16 and battery 17 are mounted to the recoil starter case 27 integrally therewith. An integral unit comprising the recoil starter 14, motor 16, and battery 17 is fixed to one side of the fan case 19 by bolts 59, 59 . . . at four locations, as FIG. 1 shows. It is noted in this connection that in FIG. 3, members exterior of the driving member 34, except the driven member 25 integral with the flywheel 24, are assembled integrally with the recoil starter case, which are interconnected through the first clutch 35 when the integral unit is mounted in position. FIG. 8 shows a unit 61 of the recoil starter specification which is not equipped with starter motor 16 and battery 17. In FIG. 8, the recoil starter case 27 of the unit 61 is fitted in position and the recoil starter wheel 30 and other members, excepting the starter motor 16 side members which are eliminated with the intermediate shaft 37. By mounting this unit 61 to the side of the fan case 19 in place of the FIG. 7 unit 60 of the starter motor specification, or vise versa, it is easy to change the engine from the starter motor specification to the recoil starter specification, or from the recoil starter specification to the starter motor specification.

Figure 9:
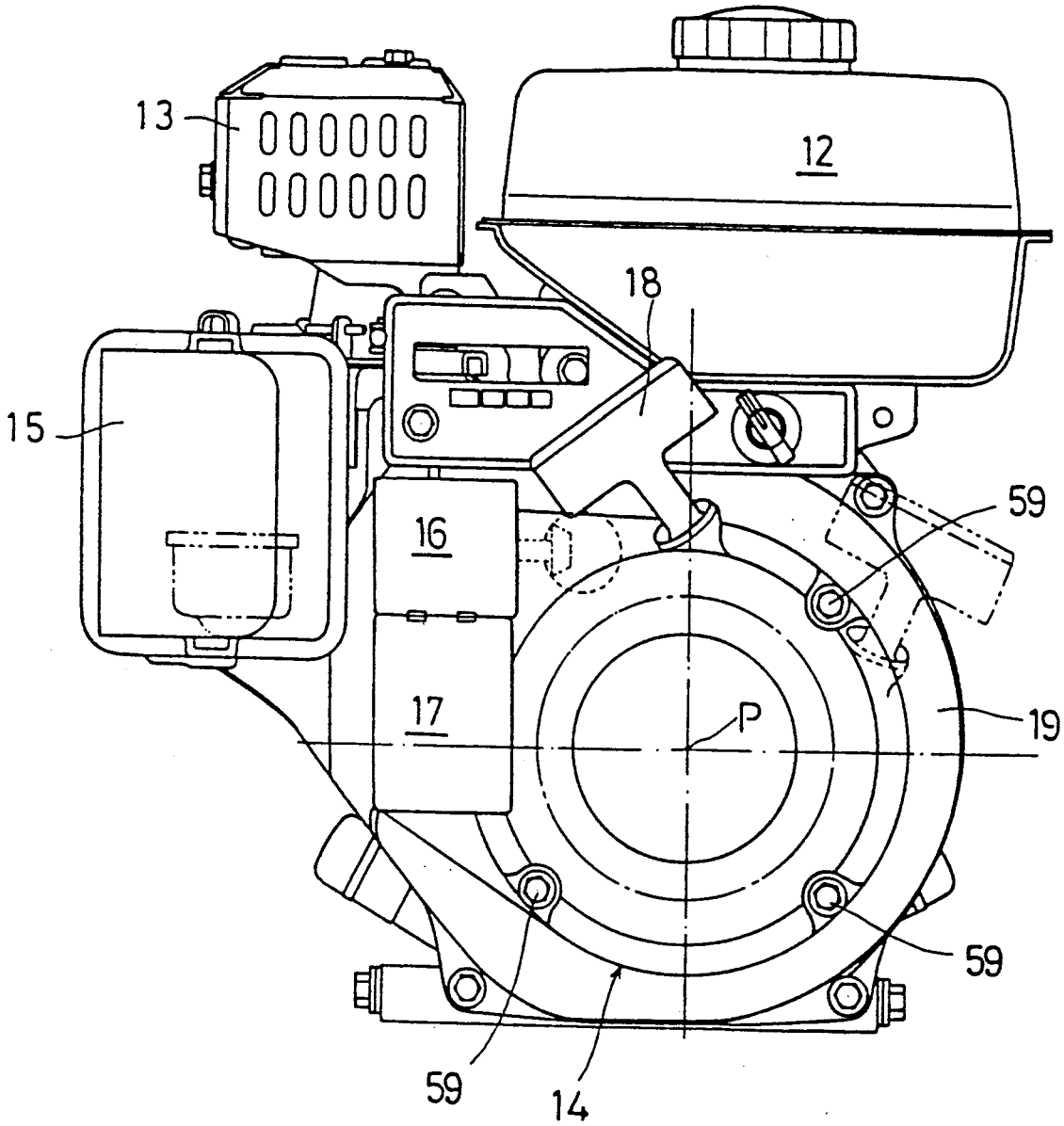
FIG. 9 is a general view in front elevation showing an engine representing another embodiment of the invention.
Figure 10:
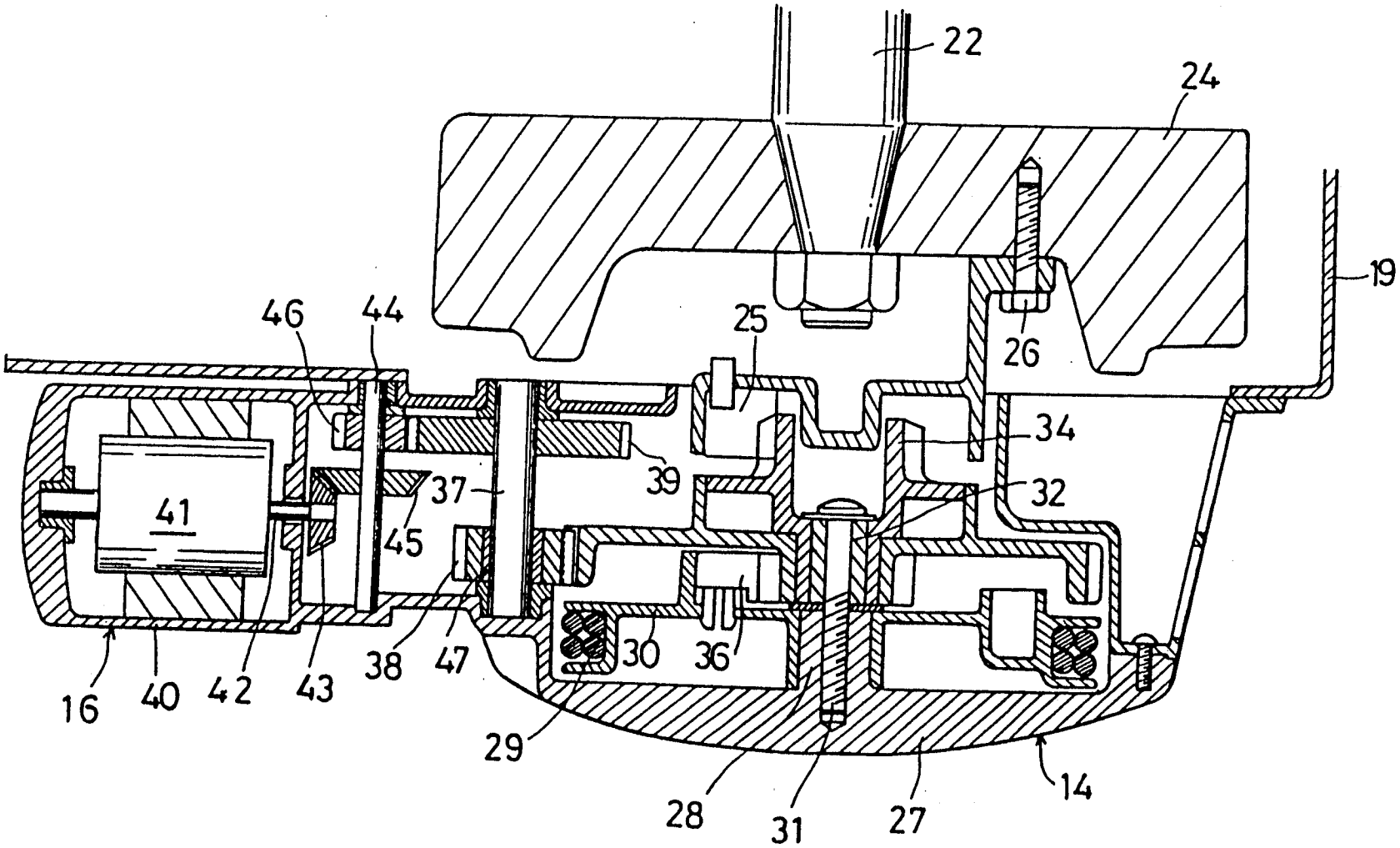
FIG. 10 is a transverse sectional plan view showing starter motor and recoil starter portions of the engine in FIG. 9.

FIG. 9 shows the starter motor 16 mounted to the recoil starter case 27 so that, as earlier mentioned, the motor shaft 42 is oriented perpendicularly to the axis P of the crankshaft. Correspondingly, the battery 17 is horizontally mounted in position. The starter motor 16 is very small in size as compared with the prior art starter motor, but its configuration is such that it is larger in its size in the direction of the motor shaft 42 than in the diametrical direction, so that, if it is mounted so as to be oriented in the crankshaft direction in FIGS. 1 to 3, its top end is positioned level with or slightly beyond the outer surface of the recoil starter case 27. Therefore, by being horizontally mounted as above mentioned, the starter motor 16 can be conveniently housed in the dead space between the air cleaner 15 and the recoil starter 14, without being allowed to project beyond the outer surface. Accordingly, as FIG. 10 shows, for both the drive pinion 43 on the motor shaft 42 and the driven gear 45 on the driven shaft 44 which is engageable therewith, bevel gears are employed. It is of course possible to employ worms and worm gears in place of such bevel gear mechanism.

Figure 11:
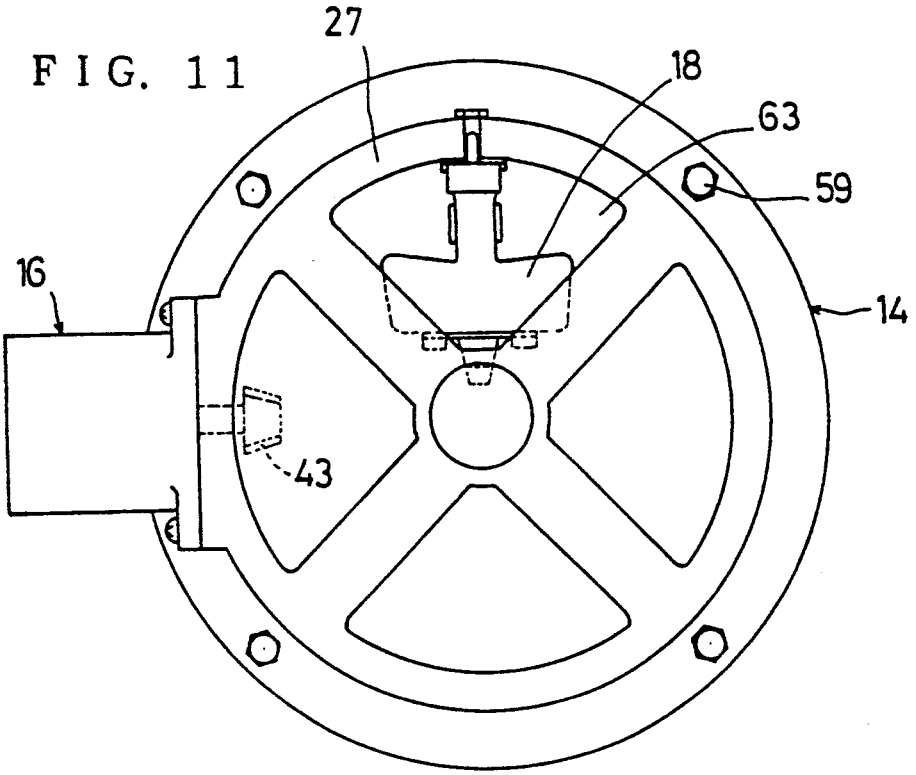
FIG. 11 is a front view showing another form of recoil starter.
Figure 12:
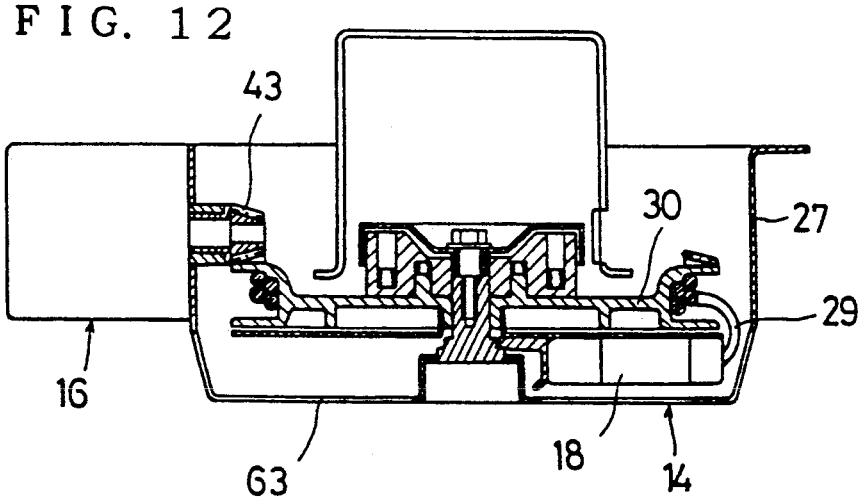
FIGS. 12 and 13 are fragmentary plan views in transverse section showing the recoil starter in FIG. 11.
Figure 13:
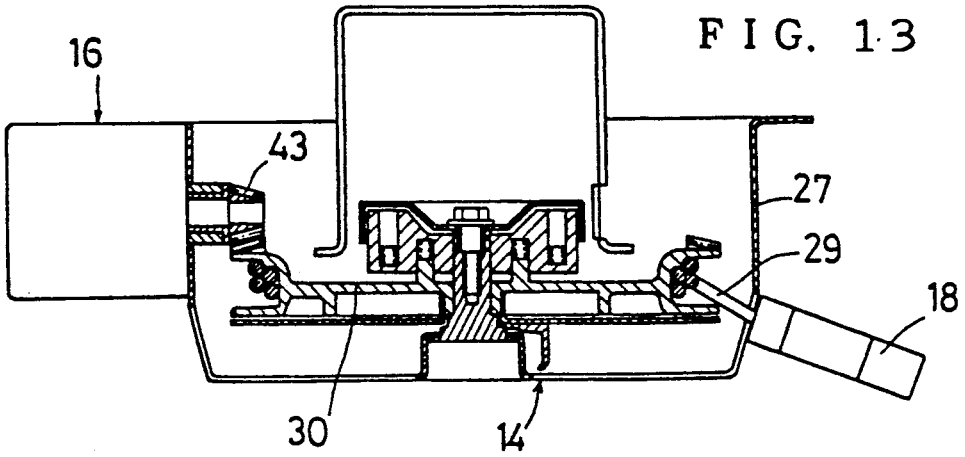

FIGS. 11 and 12 illustrate another embodiment of the invention, in which the puller 18 for the recoil starter 14 is housed in the recoil starter case 27. This arrangement provides an advantage that when the starter motor 16 is driven, the recoil starter 14 side wheel 30 may be allowed to rotate without involving any inconvenience, with the result that a second clutch 36, between the starter motor 16 and the recoil starter 14, can be eliminated. The puller 18 is fitted in folded pattern internally of an opening 63 formed at one side of the recoil starter case 29. For the purpose of starting, the puller 18 is drawn through the opening 63 for manipulation as FIG. 13 shows. In these embodiments, as FIG. 9 shows, the motor shaft 42 of the starter motor 16 is mounted in orthogonal relation with the crankshaft axis P; but alternatively, it may be mounted in same orientation as the crankshaft axis P as in FIGS. 1 and 2.

Nextly, means for enabling the engine to be started in a low revolution region of less than 350 rpm will be explained which permit the compacting of the starter motor 16 and battery 17, as above described, such that they are housed within a space corresponding to the width of the recoil starter 14.

As is well known, in order to bring the crankshaft of an engine into rotation at the time of starting, it is required that a compression stage in the vicinity of the top dead point of the piston be surmounted, and to this end a very large force is required. In order to overcome this problem, it is necessary to release the compression by forcibly opening an exhaust valve or intake valve. In the present invention, the necessary capacity of the starter motor 16 can be reduced by employing an automatic decompression device for automatic release of compression at a so-called low rate revolution stage. A decompression device of this type is disclosed, for example, in Japanese Patent Application No. 59-11539 (Japanese Patent Laid-Open Publication No. 60-156976) filed by the present applicant in which a centrifugal automatic decompression device is described. This decompression device is such that a pin is moved in the diametrical direction of a cam shaft under a centrifugal weight becoming displaced as the cam shaft rotates so that a tappet being pushed upward by the pin for decompression. According to this device, the centrifugal weight moves automatically toward decompression at the stage of low speed rotation and, therefore, decompression can be obtained at the time of starting without any particular control being required.

Figure 14:
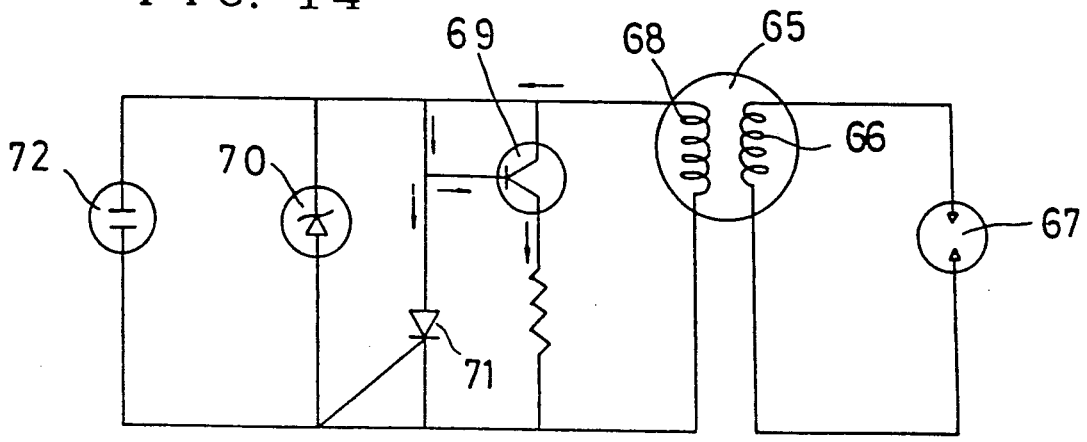
FIG. 14 is a diagram showing a power circuit for an ignition device for use in the embodiments of the invention.
Figure 15:
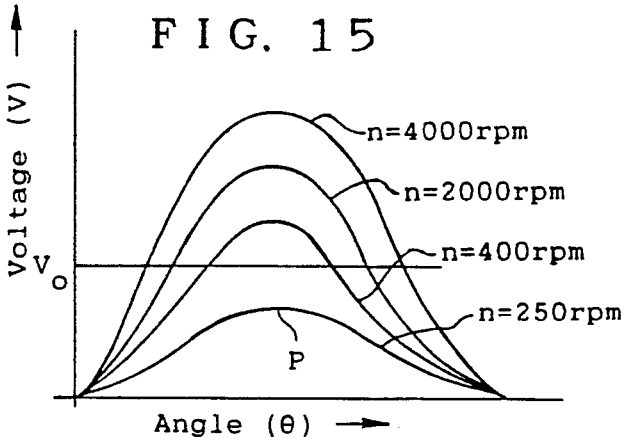
FIG. 15 is a graphic representation showing changes in voltage generated by an ignition device for ignition according to the flywheel magnet system.

FIG. 14 shows an electrical circuit for an ignition power supply unit employed in the present invention. In FIG. 14, a secondary coil 66 of an ignition coil 65 and a spark plug 67 are interconnected in series. Across a primary coil 68 are interconnected collector and emitter side terminals for a transistor 69 in parallel relation with the primary coil 68. Likewise, across the transistor 69 are interconnected anode and cathode terminals of a thyristor 70 in parallel, the anode side terminal of the thyristor 70 being connected to a base of the transistor 69. Two terminals of a Zener diode 71 are connected in parallel to the anode and cathode terminals of the thyristor 70, and the anode side of the Zener diode 71 is connected to a gate terminal of the thyristor 70. FIG. 15 shows voltage wave forms generated in the primary coil 68. A voltage generating unit employed in this embodiment is of the flywheel magnet type which generates an AC voltage as the flywheel rotates. When the voltage generated is lower than operating voltage $V_0$ for the Zener diode 71, the voltage is applied to the base side of the transistor 69. When the generated voltage exceeds the operating voltage $V_0$, the voltage is applied to the gate terminal of the thyristor 70, so that current flows across the anode and cathode sides of the thyristor 70 (in the direction of broken-line arrow) so that the base voltage in the transistor 69 is reduced with the result that the current flowing across the collector and emitter sides of the transistor 69 is interrupted. Accordingly, a large secondary voltage develops in the secondary coil 66 to ignite the spark plug 67.

As FIG. 15 shows, the voltage developed in the primary coil 68 varies according to the number of revolutions of the engine. For example, when the number of revolutions of the engine is of the order of 250 rpm, the generated voltage is lower than the operating voltage $V_0$ for the Zener diode 71. Therefore, the current flowing in the transistor 69 is not interrupted and hence no large voltage can be developed in the secondary coil 66. For this reason, in this embodiment a capacitor 72, as shown, is provided in parallel with the Zener diode 71 so that a voltage peak point P due to charge/discharge conversion of the capacitor 72 is detected by a detection circuit, whereby at time of low speed rotation when only a voltage lower than Volyage $V_0$ is generated, a signal for releasing the transistor 69 from conduction is issued to cut off the current in the primary coil 68 for ignition.

Figure 16:
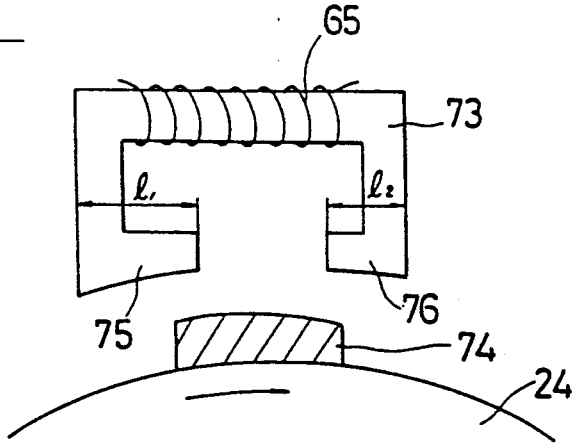
FIG. 16 is a schematic illustration showing a flywheel magnet system power generating unit for use in the embodiments of the invention.
Figure 17:
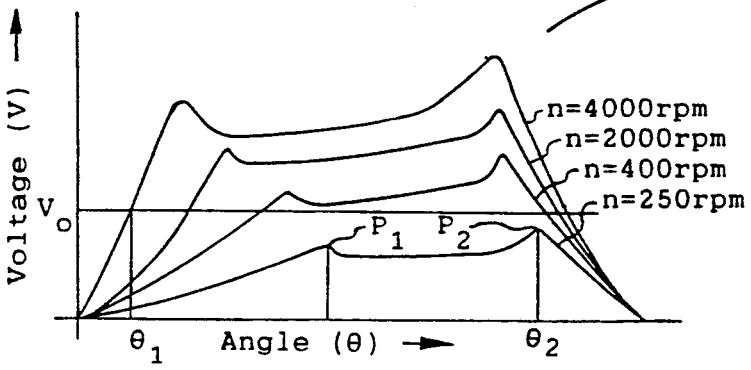
FIG. 17 is a graph showing wave forms of voltages generated by the power generating unit in FIG. 16.
Figure 18:
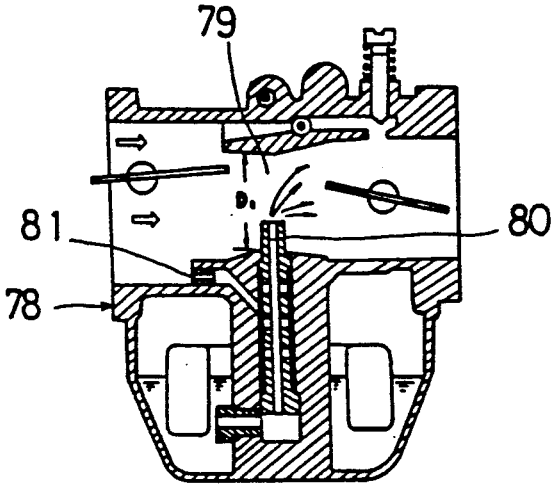
FIG. 18 is a fragmentary longitudinal sectional view showing a carbureter for use in the embodiments of the invention.
Figure 19:
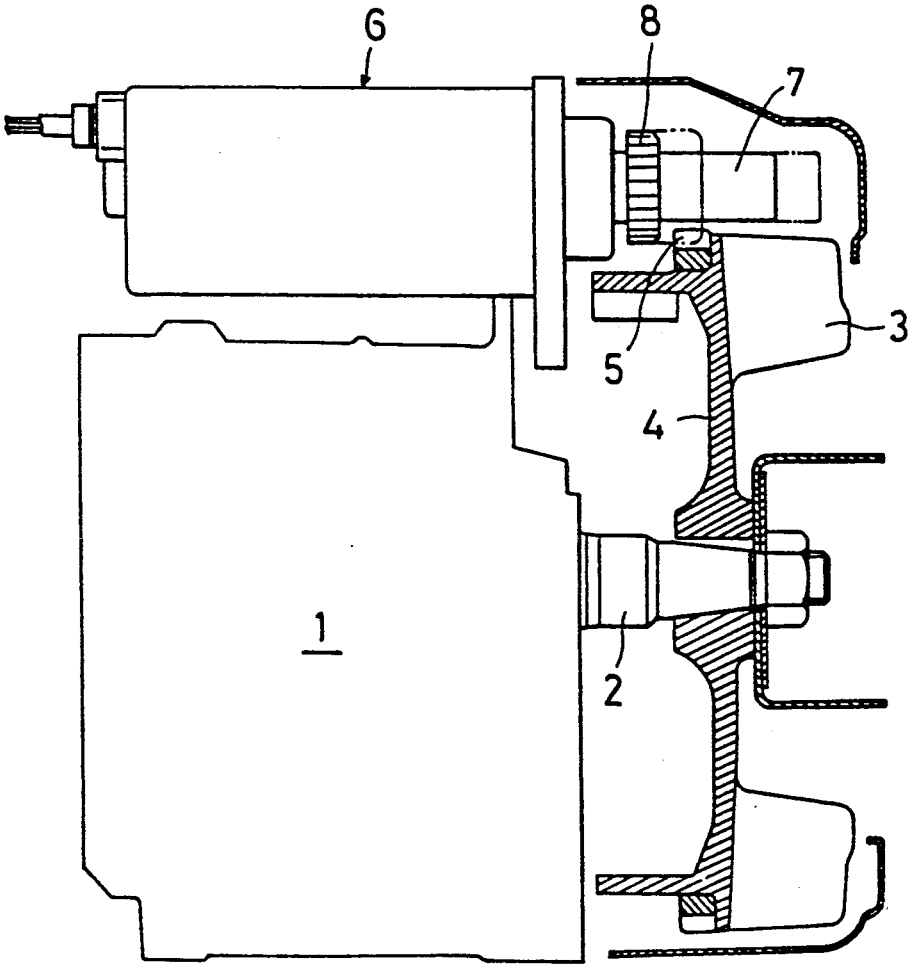
FIG. 19 PRIOR ART
FIG. 19 is a fragmentary transverse sectional view in plan of an engine showing a prior art arrangement for starter motor mounting.

In order to prevent reverse rotation during the process of slow starting, an ignition device of the flywheel magnet type is employed in this embodiment such that an inverted C-shaped iron core 73 on which the ignition coil 65 is wound is configured as shown in FIG. 16 so that ignition timing during low speed rotation is delayed. That is, in FIG. 16, the iron core 73 has at its ends opposed lips 75, 76 and is fixedly disposed in opposed relation to a magnet 74 of the flywheel 24, and on this iron core 73 is wound the ignition coil 65. Further, in this embodiment, the length $l_1$ of the lip 75 at the trailing side in the direction of rotation of the flywheel 24 is greater than the length $l_2$ of the other lip 76, at the leading side whereby the wave form of the voltage generated in the primary coil 68 is varied as shown in FIG. 17 so that the amount of ignition delay during low speed rotation is made greater than that in FIG. 15. In FIGS. 14 and 15, during low speed rotation of the order of 250 rpm in which the voltage generated is lower than operating voltage $V_0$, voltage peak point P is detected on the basis of which an interruption signal is generated. In the wave forms shown in FIG. 17, there appear two peak points, namely, first peak point $P_1$ and second peak point $P_2$. In this case, if current is interrupted at first peak point $P_1$, the resulting angular delay is still insufficient in relation to ignition angle $\theta_1$ during maximal speed rotation and, therefore, it is necessary that an interruption signal be given at second peak point $P_2$ in order to provide increased angular delay $\Delta\theta=\theta_2-\theta_1$ during low speed rotation in relation to maximal rotation region, thereby to obtain a sufficient angular delay that will not cause such reverse rotation as above noted. Such second peak point $P_2$ can easily be detected by employing a microcomputer having, for example, decision means for making decision as to whether a peak point is a first peak point or a second peak point, and control means for generating an interruption signal, at the second peak point, with respect to the transistor on the basis of the decision so made. In exemplary tests made with the present embodiment, a particular angular delay $\Delta\theta$ obtained in relation to a maximal rotation period was 7 degree.

In order to obtain improved ignition performance at time of low speed rotation, a voltage greater than the conventional level of 8 kV/250 rpm is used in the present embodiment for the voltage in the secondary coil 66 for igniting the spark plug 67.

Even if sparking can be effected in a low revolution region without involving reverse rotation, no ignition can result unless fuel in a proper air fuel ratio is supplied from the carburetor into the cylinder during the low speed rotation stage. In this embodiment, therefore, in order to provide an air fuel ratio appropriate enough to permit good ignition at a low revolution region of less than 350 rpm, the diameter $D_1$ of a Venturi portion 79 of the carburetor is designed to be smaller than that of the conventional one so as to allow increased inflow rate at that portion, thereby to insure accurate intake of fuel through a nozzle 80. Selection of an appropriate combination of take-up position for an air jet 81 and configuration of a nozzle 80 can also provide a reasonable air fuel ratio during slow speed rotation, it being thus possible to permit accurate starting without choke control, even at time of cold starting.

By employing any or all of these means in a suitable combination it is possible to start the engine under a small torque in a low speed region of less than 350 rpm, and thus to considerably reduce necessary capacity of the starter motor 16 as compared with that of the conventional one and correspondingly reduce the size of the battery.

ADVANTAGES OF THE INVENTION

As above described, according to the invention, by enabling the engine to be started in a low revolution region, the starter motor is reduced in size so that it can be easily mounted in position, and therefore the engine as a whole can be noticeably compacturized. The reduction in size of the motor permits the battery to be correspondingly reduced in size. Thus, it is possible to mount both the motor and the battery to the engine. Such mounting of both the motor and the battery eliminates the necessity of wiring to be made between the motor and the battery when the engine is loaded on a field working machine or when it is used as a general-purpose engine. Moreover, when the engine is loaded on such working machine, no extra space or bracket is required for battery loading. Engines of both the starter motor specification and the recoil starter specification can be housed in combination within spaces of nearly same size.

In one form of arrangement according to the invention, the motor is mounted in position integrally with the recoil starter, and the recoil starter and the motor are connected together in interlocking relation. According to this arrangement, it is not necessary to arrange for engagement of the starter motor with the ring gear of the crankshaft as in the prior art arrangement. Therefore, even where no such ring gear is present, the assembly can be mounted only by replacing the recoil starter.

In another form of arrangement according to the invention, wherein the starter motor is mounted above the axis of the crankshaft, the starter motor is protected from dust, dirt, soil, and water underneath even when the assembly is installed on the ground for use. This means less maintenance required. Generally, an engine of this sort has dead spaces around a cylinder head at upper side of the crankshaft and/or under a fuel tank. The starter motor can be conveniently mounted in position by utilizing such dead space.

In another form of arrangement according to the invention, wherein the starter motor and the battery are disposed in side by side relation, connections can be made simply by bringing their terminals into contact, no wiring being thus required.

In another form of arrangement according to the invention, wherein the starter motor is mounted in position such a way that it is longitudinally oriented in horizontal relation to the crankshaft, the starter motor can be compactly housed, for example, in a dead space at one side of the recoil starter without being allowed to project in the direction of the crankshaft.

In another form of arrangement according to the invention, wherein by permitting the engine to be started in a low revolution region the starter motor is reduced in size and mounted in position so that it is housed, at same side as the recoil starter, in a space corresponding approximately to the width of the recoil starter, the engine as a whole can be considerably compacturized without involving the possibility of the starter motor projecting outwardly to render the engine to be large sized. In addition, the reduction in size of the motor permits the battery to be reduced in size, it being thus possible to mount both the motor and the battery to the engine.

Mounting of both the motor and the battery to the engine eliminates the necessity of wiring to be made between the motor and the battery when the engine is loaded on a field working machine or when it is used as a general-purpose engine. Moreover, when the engine is loaded on such working machine, no extra space or bracket is required for battery loading. Engines of both the starter motor specification and the recoil starter specification can be housed in combination within spaces of about same size.

According to the invention, by enabling the engine to be started in a low revolution region, the starter motor and battery are reduced in size so that they can be easily mounted in position, and therefore the engine as a whole can be notably compacturized. Such mounting of both the motor and the battery to the engine eliminates the necessity of wiring to be made between the motor and the battery when the engine is loaded on a field working machine or when it is used as a general-purpose engine Further, when the engine is loaded on such working machine, no extra space or bracket is required for battery loading. Engines of both the starter motor specification and the recoil starter specification can be commonly housed within spaces of about same size. Furthermore, since the battery is removable from the engine, it can be readily charged utilizing a commercial power supply when it is removed from the engine, and it is handy for transport in that connection.

What is claimed is:

1. A starting apparatus for a 4-cycle gasoline engine having a crankshaft, a fan case around said crankshaft and means for automatically releasing the compression in said engine at a crankshaft revolution region not greater than 350 rpm and at which starting of said engine is to be initiated, said starting apparatus comprising a starter motor case mounted on said fan case, a starter motor and a recoil starter mounted in said starter motor case, said starter motor having a capacity for starting said engine at a crankshaft revolution region not greater than 350 rpm and being interconnected with a rotary portion of said recoil starter for starting said engine with a selected one of said starter motor and said recoil starter and a power supply battery for energizing said starter motor, said starter motor and said recoil starter being of substantially the same length in the axial direction of said crankshaft.

2. A starting apparatus as set forth in claim 1, wherein said starter is interconnected to said recoil starter at a level above a horizontal axis of said crankshaft.

3. An engine starting apparatus as set forth in claims 1 or 2 wherein said starter motor and said battery are mounted in side by side relation.

4. An engine starting apparatus as set forth in claim 1 or 2 wherein said starter motor has a shaft and said starter motor is mounted so that said shaft is oriented in orthogonal relation to the axis of said crankshaft.

5. An engine starter apparatus as set forth in claim 1, wherein said power supply battery is mounted on said starter motor case.

6. A starting apparatus as set forth in claim 1, wherein said power supply battery is removable mounted on said starter motor case.

* * * * *